US005370529A

United States Patent [19]

Lu et al.

[11] Patent Number: 5,370,529

[45] Date of Patent: Dec. 6, 1994

[54] LOW $NO_x$ COMBUSTION SYSTEM FOR FUEL-FIRED HEATING APPLIANCES

[75] Inventors: Lin-Tao Lu; Larry R. Mullens; Keith M. Grahl, all of Fort Smith, Ark.

[73] Assignee: Rheem Manufacturing Company, New York, N.Y.

[21] Appl. No.: 111,297

[22] Filed: Aug. 24, 1993

[51] Int. Cl.[5] ..... F23D 14/62; F24H 9/00

[52] U.S. Cl. ..... 431/353; 126/116 R; 431/350; 431/354; 431/326

[58] Field of Search ..... 431/350, 352, 354, 353, 431/351, 7, 170, 326; 126/116 R, 92 C, 92 AC

[56] References Cited

U.S. PATENT DOCUMENTS

| | | | |
|---|---|---|---|
| 2,059,523 | 11/1936 | Hepburn et al. | 431/352 X |
| 3,554,182 | 1/1971 | Whitacre | 431/354 X |
| 3,765,389 | 10/1973 | Henchel | 431/352 X |
| 3,917,442 | 11/1975 | Zagoroff | 431/352 X |
| 4,141,213 | 2/1979 | Ross | 431/352 X |
| 4,412,523 | 11/1983 | Schreiber et al. | 126/92 |
| 4,525,141 | 6/1985 | De Werth et al. | 431/347 |
| 4,531,904 | 7/1985 | Sato et al. | 431/10 |
| 4,616,994 | 10/1986 | Tomlinson | 431/347 |
| 4,619,604 | 10/1986 | Pickering | 431/353 |
| 4,776,320 | 10/1988 | Ripka et al. | 126/99 A |
| 4,800,866 | 1/1989 | Finke | 126/91 A |
| 4,904,179 | 2/1990 | Drago et al. | 431/347 X |
| 4,974,579 | 12/1990 | Shellenberger et al. | 126/110 R |
| 5,057,007 | 10/1991 | Andringa et al. | 431/328 |
| 5,203,689 | 4/1993 | Duggan et al. | 431/354 |

*Primary Examiner*—Carl D. Price

*Attorney, Agent, or Firm*—Konneker Bush Hitt & Chwang

[57] ABSTRACT

A fuel-fired, forced air draft induced heating furnace is provided with $NO_x$ reduction apparatus associated with a plurality of combustor tubes forming a portion of its heat exchanger structure. In-shot type fuel burners are spaced apart from and face the open inlet ends of horizontal combustion sections of the combustor tubes. The $NO_x$ reduction apparatus includes a plurality of metal mesh tubes having diameters substantially less than the internal diameters of the combustion tubes. The mesh tubes are coaxially supported within the combustor tubes, adjacent their inlet ends, by elongated support members longitudinally passing through the mesh tubes and having first ends anchored to the combustor tube inlet ends, and second ends slidably resting on internal side surface portions of the combustor tubes. During burner operation the burner flames injected into the combustor tubes are forced through the mesh tubes which operate to laterally reduce the cross-sections of the flames, increase their axial velocity through the combustor tubes, and substantially diminish the intimate contact of secondary combustion with the maximum temperature zones of the flames within the combustor tubes.

19 Claims, 3 Drawing Sheets

LOW $NO_x$ COMBUSTION SYSTEM FOR FUEL-FIRED HEATING APPLIANCES

BACKGROUND OF THE INVENTION

The present invention generally relates to fuel-fired heating appliances, such as furnaces, water heaters and boilers and, in a preferred embodiment thereof, more particularly relates to apparatus and methods for reducing $NO_x$ emissions generated by the combustion systems in such appliances.

Nitrogen oxide ($NO_x$) emissions in fuel-fired heating appliances, such as furnaces, water heaters and boilers, are a product of the combustion process, and are formed when the combustion reaction takes place at high temperature conditions typically encountered in such heating appliances. $NO_x$ emissions became an environmental issue in the late 1960's and early 1970's due to their detrimental role in atmospheric visibility, photochemical smog and acid deposition. Regulations in the subsequent decade led to significantly reduced amounts of $NO_x$ emissions.

Current SCAQMD (South Coast Air Quality Management District) regulations for residential furnaces and water heaters limit $NO_x$ emissions to 40 ng/j of useful heat generated by these types of fuel-fired appliances. Growing environmental concern is leading to even more stringent regulation of $NO_x$ emissions. For example, regulations currently being proposed by SCAQMD for water heaters and boilers limit $NO_x$ emission levels to 30 ppm at 3% oxygen, which is approximately 20.5 ng/j for middle efficiency water heaters and boilers. Conventional fuel-fired appliance combustion systems are not currently capable of meeting these more stringent limitations. For example, a typical in-shot burner system typically employed in these types of fuel-fired appliances produces $NO_x$ emission levels in the range of from about 50 ng/j to about 70 ng/j.

One technique currently used to lower $NO_x$ emissions in fuel-fired heating appliances is to position a heat absorbing flame insert within the burner flame path for "quenching" purposes. The resulting lowered combustion flame temperature results in lowered $NO_x$ emission rates. For example, as shown in U.S. Pat. No. 5,146,910, flame cooling can be achieved by placing an insert within the burner flame zone. The insert receives heat from the flame and radiates heat away to thereby cool the flame. Using this quenching technique, gas furnaces with flame inserts are now in commercial production and have $NO_x$ emission rates of somewhat less than about 40 ng/j.

Flame insert methods are relatively easy and inexpensive to implement. However, $NO_x$ reduction achieved by existing flame inserts is rather limited because conventional flame insert designs are operative solely through a flame cooling mechanism and, for a given combustion system, only limited flame cooling can be realized without jeopardizing the combustion process itself. Due to this practical limitation, existing flame inserts are able to reduce $NO_x$ emissions to about 30 ng/j—considerably short of the proposed emission limitation set forth above.

Some advanced combustion systems such as infrared/porous matrix surface burners, catalytic combustion and fuel/air staging could reach a very low $NO_x$ emission level in compliance with these proposed emission standards, but these methods tend to be quite expensive and usually require extensive system modification. Accordingly, they are not suited for retrofitting existing combustion systems to achieve the desired substantial reduction in system $NO_x$ emissions.

From the foregoing it can be seen that it would be highly desirable to provide improved $NO_x$ reduction apparatus, for use in fuel-fired heating appliances of the type generally described above, which will enable the meeting of the proposed $NO_x$ emission standards in a cost-effective manner and is suitable for retrofitting existing combustion systems with the reduction apparatus. It is accordingly an object of the present invention to provide such improved $NO_x$ reduction apparatus.

SUMMARY OF THE INVENTION

In carrying out principles of the present invention, in accordance with a preferred embodiment thereof, a reduced $NO_x$ emission combustion system is incorporated in a fuel-fired heating appliance, representatively a forced air furnace.

The combustion system includes a combustor tube having an open inlet end and an essentially straight combustion section longitudinally extending inwardly from the open inlet. A fuel burner, representatively of the in-shot type, is operative to inject a flame and resulting hot combustion gases into the open inlet end for flow through the combustion section in a manner drawing ambient secondary combustion air into the combustion section around the flame. The fuel burner has a generally circular flame outlet section from which the flame is discharged. The flame outlet section of the burner is coaxial with the combustion section and has a diameter substantially smaller than the internal diameter of the combustor tube combustion section.

A perforate tubular flame control member is coaxially supported in the combustion section in the path of the fuel burner flame and has a diameter substantially less than the internal diameter of the combustor tube. The tubular flame control member, preferably formed from a metal mesh material, is operative to cause an axial portion of the fuel burner flame to longitudinally pass therethrough in a manner reducing the lateral dimension of the axial flame portion, increasing its velocity, and substantially shielding it from intimate contact with the ambient secondary combustion air entering the combustion section around the burner flame. This action of the flame control member on the injected burner flame very substantially reduces the $NO_x$ emissions of the furnace.

The tubular flame control member is preferably supported within the combustor tube by means of an elongated support member longitudinally extending through the interior of the flame control member and having a first end anchored to the open inlet end of the combustor tube, and a second end slidably resting on a bottom interior side surface portion of the combustor tube. Because the support member is anchored at only one end thereof it may thermally contract or expand within the combustor tube without transmitting thermal stress forces to the combustor tube or receiving thermal stress forces therefrom as the case may be.

According to other aspects of the invention the metal mesh flame control tube is configured relative to the heat exchanger structure with which it is associated in a manner enhancing the $NO_x$ reduction achieved by the flame control tube. For example, in illustrated preferred embodiment of the invention, the metal mesh tube is formed from metal wire having a diameter of about 0.014 inches; the diameter of the metal mesh tube is approximately equal to the diameter of the flame holder section of the burner; the length of the metal mesh tube is about one half the length of the combustion section of the combustor tube; the distance from the burner to the metal mesh tube is within the range of from about one to two times the diameter of the metal mesh tube; and the mesh size of the flame control tube is approximately 30×32.

DETAILED DESCRIPTION

Figure 1:
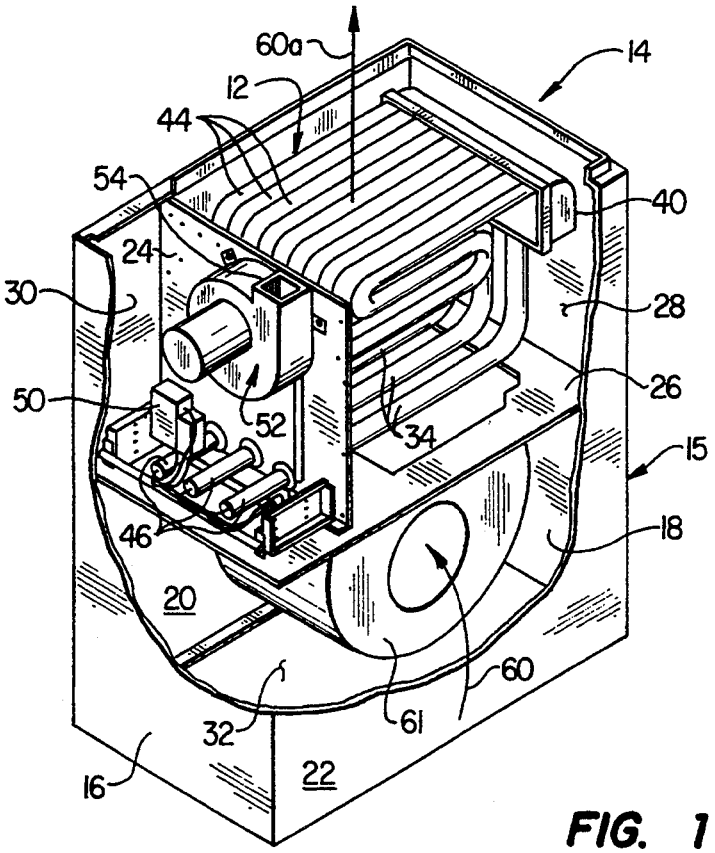
FIG. 1 is a partially cut away perspective view of a representative forced air, fuel-fired furnace incorporating therein specially designed $NO_x$ reducing apparatus embodying principles of the present invention.
Figure 2:
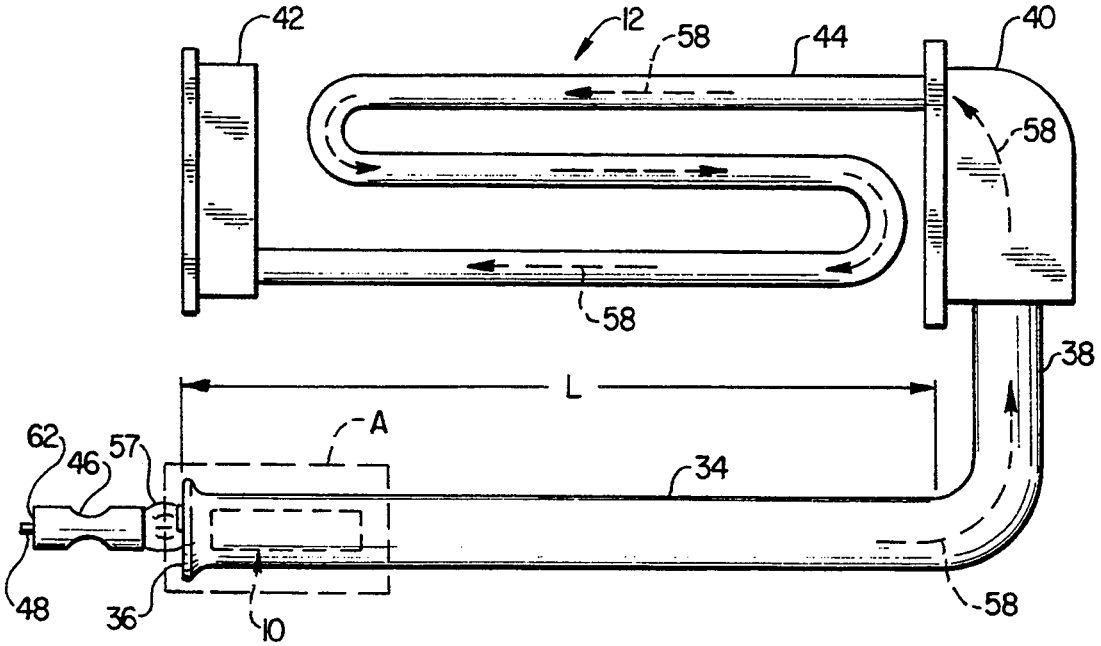
FIG. 2 is an enlarged scale side elevational view of the heat exchanger portion of the furnace.

As later described herein the present invention provides specially designed $NO_x$ reduction apparatus 10 (schematically illustrated in FIG. 2) for incorporation in the combustion systems of fuel-fired heating appliances such as furnaces, water heaters and boilers. By way of example the $NO_x$ reduction apparatus is shown in FIGS. 1 and 2 as being operatively installed in the heat exchanger section 12 of a high efficiency fuel-fired heating furnace 14 as illustrated and described in U.S. Pat. No. 4,974,579.

Referring initially to FIGS. 1 and 2, the furnace 14 includes a generally rectangularly cross-sectioned housing 15 having vertically extending front and rear walls 16 and 18, and opposite side walls 20 and 22. Vertical and horizontal walls 24 and 26 within the housing 15 divide the housing interior into a supply plenum 28 (within which the heat exchanger 12 is positioned), a fan and burner chamber 30, and an inlet plenum 32 beneath the plenum 28 and the chamber 30.

Heat exchanger 12 includes three relatively large diameter, generally L-shaped primary combustor flame tubes 34 which are horizontally spaced apart and secured at their open inlet ends 36 to a lower portion of the interior vertical wall 24. As best illustrated in FIG. 2, each of the combustor tubes 34 has an essentially straight horizontal combustion section L extending inwardly from its inlet end 36. The upturned outlet ends 38 of the tubes 34 are connected to the bottom side of an inlet manifold 40 which is spaced rightwardly apart from a discharge manifold 42 suitably secured to an upper portion of the interior wall 24. The interior of the inlet manifold 40 is communicated with the interior of the discharge manifold 42 by means of a horizontally spaced series of vertically serpentined flow transfer tubes 44 each connected at its opposite ends to the manifolds 40,42 and having a considerably smaller: diameter than the combustor tubes 34.

Three horizontally spaced apart "in-shot" type gas burners 46 are operatively mounted within a lower portion of the chamber 30 and are supplied with gaseous fuel (such as natural gas) through supply piping 48 by a gas valve 50. As can be seen in FIG. 2, each burner 46 is spaced outwardly apart from, and faces, the open inlet end 36 of its associated combustor tube 34. It will be appreciated that a greater or lesser number of combustor tubes 34, and associated burners 46 could be utilized, depending on the desired heating output of the furnace.

A draft inducer fan 52 positioned within the chamber 30 is mounted on an upper portion of the interior wall 24, above the burners 46, and has an inlet communicating with the interior of the discharge manifold 42, and an outlet section 54 that may be operatively coupled to an external exhaust flue (not shown).

Upon a demand for heat from the furnace 14, by a thermostat (not illustrated) located in the space to be heated, the burners 46 and the draft inducer"fan 52 are energized. As best illustrated in FIG. 2, flames 57 and resulting hot products of combustion 58 from the burners 46 are directed into the open inlet ends 36 of the combustor tubes 34, and the combustion products 58 are drawn through the heat exchanger 12 by the operation of the draft inducer fan 52. Specifically, the burner combustion products 58 are drawn by the draft inducer fan, as indicated in FIG. 2, sequentially through the combustor tubes 34, into the inlet manifold 40, through the flow transfer tubes 44 into the discharge manifold 42, from the manifold 42 into the inlet of the draft inducer fan 52, and through the fan outlet section 54 into the previously mentioned exhaust flue to which the draft inducer outlet is connected.

At the same time return air 60 from the heated space is drawn upwardly into the inlet plenum 32 and flowed into the inlet of a supply air blower 61 disposed therein. Return air 60 entering the blower inlet is forced upwardly into the supply air plenum 28 through the illustrated opening in the interior housing wall 26. The return air 60 is then forced upwardly and externally across the heat exchanger 12 to convert the return air 60 into heated supply air 60*a* which is upwardly discharged from the furnace through its open top end to which a suitable supply ductwork system (not illustrated) is connected to flow the supply air 60*a* into the space to be heated.

Figure 6:
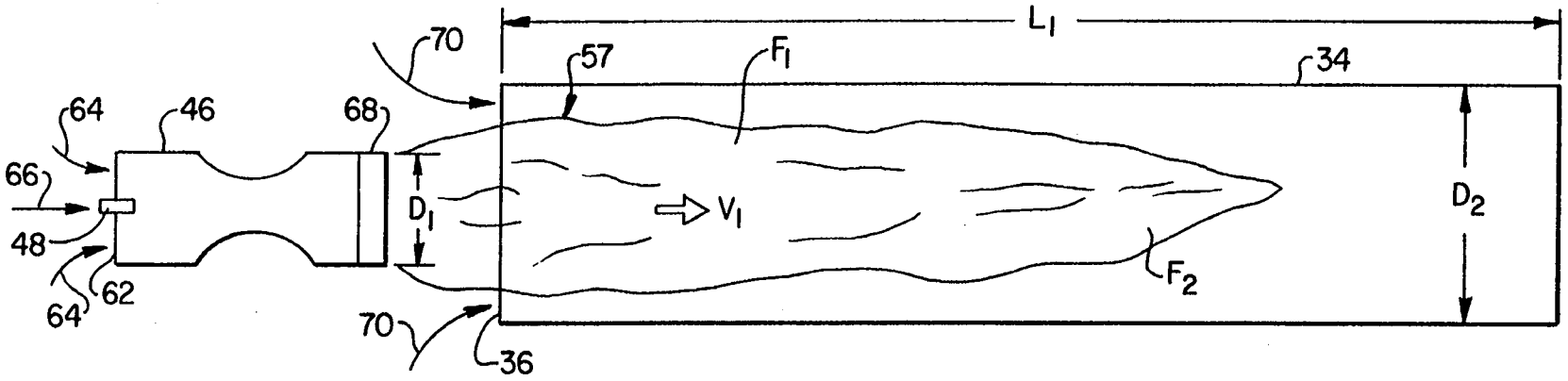
FIG. 6 (PRIOR ART)
FIG. 6 (PRIOR ART) is a highly schematic cross-sectional view through the combustor tube illustrating its conventional operation in the absence of the $NO_x$ reducing apparatus of the present invention.

FIG. 6 (PRIOR ART) schematically illustrates the operation of the combustor tubes 34, and the in-shot fuel burners 46 associated therewith, in the absence of the $NO_x$ reduction structures 10 installed within the combustor tubes as schematically indicated in FIG. 2. The illustrated burners 46 are of a conventional construction and have open left or inlet ends 62 into which primary combustion air 64 is drawn during burner operation for mixture and combustion with fuel 66 delivered to the burner through piping 48 to produce the flame 57 injected into the open combustor tube end 36 associated with the burner.

At the right end of each burner 46 is a conventional flame holder structure 68 which is coaxial with its associated combustor tube inlet section 34. The flame holder 68 has a generally circular shape with a diameter $D_1$ which is substantially smaller than the interior diameter $D_2$ of its associated combustor tube. Accordingly, the flame 57 issuing from the flame holder 68 also has a generally circular cross-section. As the flame 57 enters the combustor tube inlet end 36 its cross-section has increased to a diameter larger than that of the flame holder 68 and somewhat smaller than the interior tube diameter $D_2$.

The injected flame 57 has a velocity $V_1$, an upstream end section $F_1$ in which the flame temperature is generally at a maximum, and a downstream end section $F_2$ in which the flame temperature has diminished. By aspiration, the injection of the flame 57 into the combustor tube 34 draws secondary combustion air 70 into the tube around the high temperature flame zone $F_1$, the incoming secondary combustion air 70 intimately contacting and mixing with the flame zone $F_1$ and supporting the combustion of the injected flame 57. The conventional combustion air/flame mechanics just described in conjunction with FIG. 6 (PRIOR ART) creates in the furnace 14 $NO_x$ emissions which the $NO_x$ reduction structures 10 of the present invention uniquely and substantially reduce in a manner which will now be described.

Figure 3:
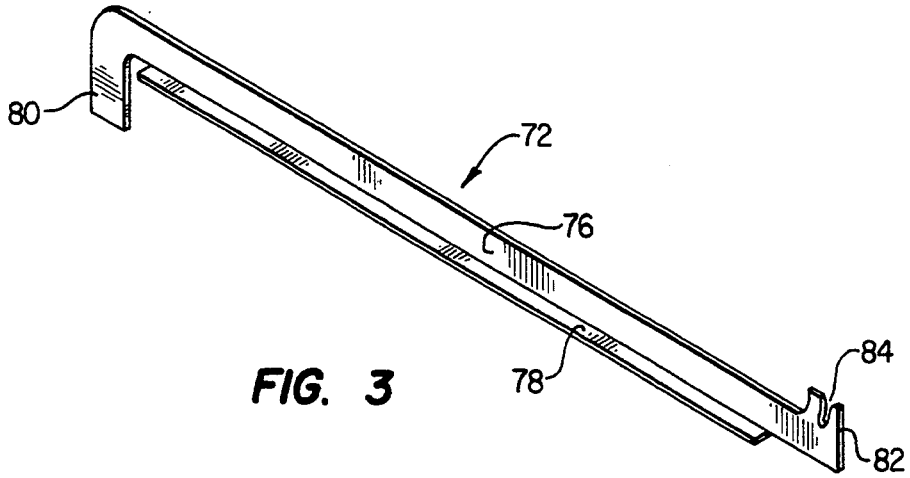
FIG. 3 is an enlarged scale perspective view of a support member portion of the $NO_x$ reducing apparatus.
Figure 4:
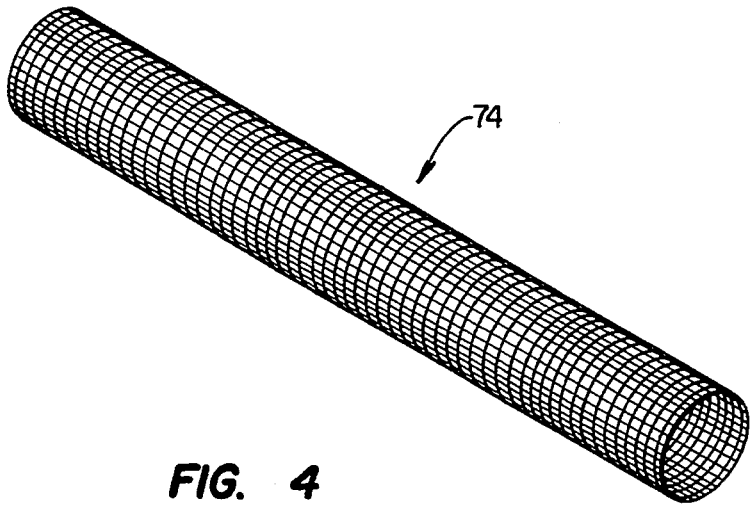
FIG. 4 is an enlarged scale perspective view of a metal mesh tube portion of the $NO_x$ reducing apparatus.
Figure 5:
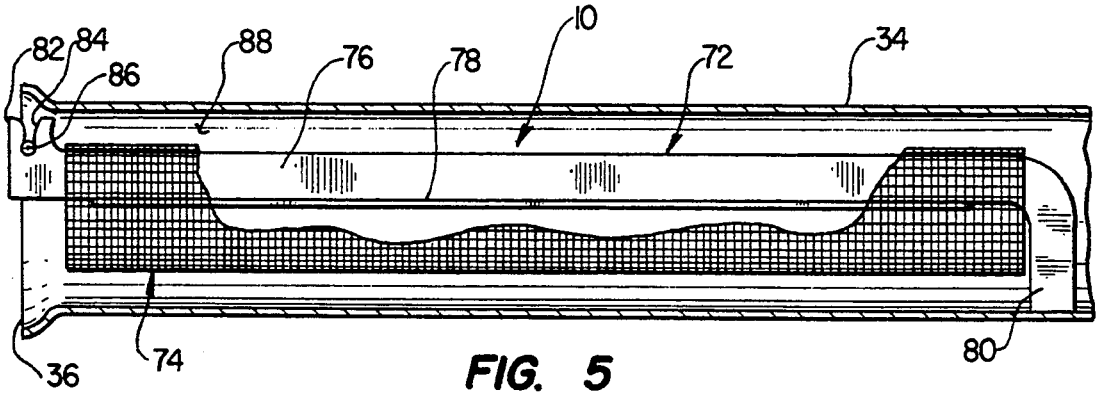
FIG. 5 is an enlarged scale, partially cut away cross-sectional view of the dotted area "A" of the heat exchanger combustor tube shown in FIG. 2 and illustrates the $NO_x$ reducing apparatus operatively installed therein.

Referring now to FIGS. 3–5, each $NO_x$ reduction structure 10 is insertable into an inlet end portion of one of the combustor tubes 34—either when the heat exchanger 12 is originally installed in the furnace 14, or later in a retrofit application. Each $NO_x$ reduction structure 10 includes an elongated metal support plate member 72 and an elongated open-ended tubular metal mesh member 74 that functions as a flame control member as later described herein. Support plate member 72 has an elongated body portion 76 with an elongated transverse stiffening rib 78 formed along a lower side edge portion thereof, a downturned inner end portion 80, and an upturned outer end portion 82 having a downwardly extending snap connection notch 84 formed therein. As indicated in FIG. 7, the tubular metal mesh member 74 has a length $L_2$ substantially less than the combustor tube length $L_1$, and a diameter $D_3$ substantially less than the interior diameter $D_2$ of the combustor tube.

Each $NO_x$ reduction structure 10 is assembled simply by inserting the outer end 82 of the support member body 76 through the interior of the metal mesh tube 74 until the tube comes to rest in its axially retained position on the support member 72 as illustrated in FIG. 5. To releasably hold the $NO_x$ reduction structure in place within its associated combustor tube 34, a small diameter metal rod 86 (see FIG. 5) is tack welded, in a horizontal orientation, to the inlet end 36 of the combustor tube 34.

The assembled structure 10 is then inserted, support member body end 80 first, into the inlet end 36 of its associated combustor tube 34, and the rod 86 is snapped into the support member body end notch 84. This positions the support member 72 within and longitudinally parallel to the combustor tube 34, with the support body inner end portion 80 bearing against the bottom interior side of the combustor tube and the tubular metal mesh member 74 coaxially supported within an inlet end portion of the combustor tube 34. The supported tubular metal mesh member 74 is inwardly offset a short distance from the tube inlet end 36, and an annular air flow space 88 is defined between the outer side surface of the tubular member 74 and the inner side surface of the combustor tube 34.

Figure 7:
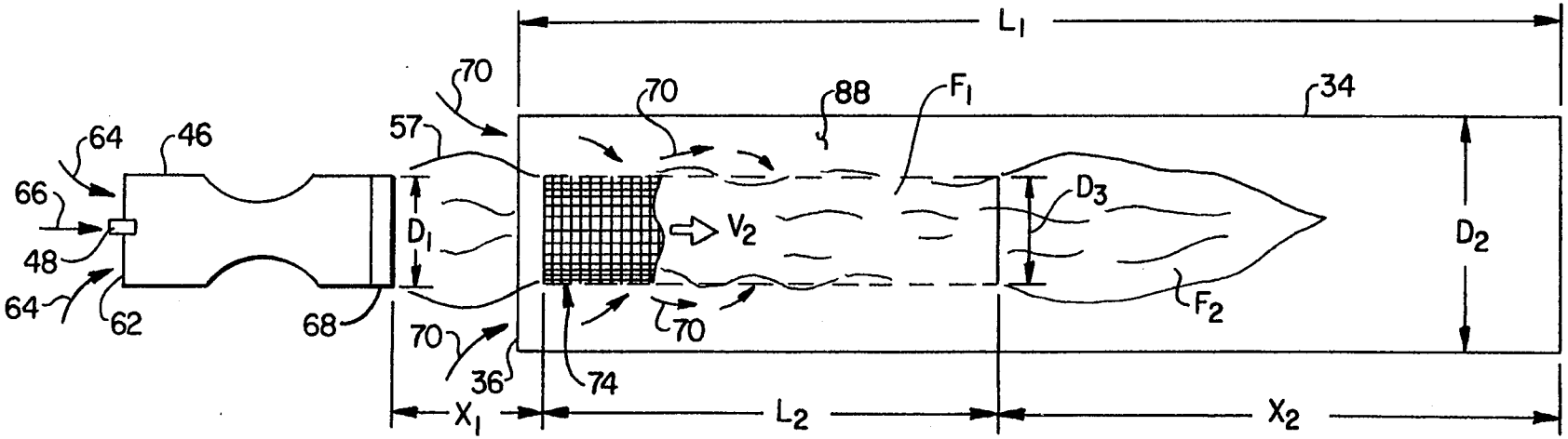
FIG. 7 is a highly schematic cross-sectional view through the combustor tube illustrating the operation of the $NO_x$ reducing apparatus, the support portion of the apparatus having been deleted for purposes of illustrative clarity.

Referring now to FIG. 7, in which the support member 72 has been deleted for purposes of illustrative clarity, during firing of the illustrated burner 46 and operation of the draft inducer fan 52 the flame 57 is passed through the tubular metal mesh member 74, thereby reducing the diameter of the high temperature flame zone $F_1$, and increasing its velocity to $V_2$, compared to the conventional flame diameter and velocity $V_1$ depicted in FIG. 6. This alteration of the flame configuration, and the velocity of its high temperature zone $F_1$, achieved by the $NO_x$ reduction structure 10 the $NO_x$ generation of the flame is substantially reduced.

More specifically, due to the close coupling between the flame 57 and the tubular metal mesh member, and the associated interaction between the flame and the member 72 the high temperature zone $F_1$ of the flame is effectively confined within the envelope of the member 72, and the flame volume is laterally reduced in the zone thereof in which $NO_x$ production is the highest. This reduced reaction zone volume and the short flue gas residence time due to the increased flame speed both contribute to reduced $NO_x$ formation.

In addition to its positive effect in changing the flame shape and speed, the $NO_x$ reduction structure 10 also alters the combustion air distribution pattern in a positive manner. Without the structure 10, as shown in FIG. 6, the flame 57 is totally exposed to the flow of secondary combustion air 70. In contrast, with the reduction structure 10 in place the perforate surface of the tubular member 74 serves as a barrier to secondary air penetration to and intimate contact with the high temperature flame region $F_1$, thereby delaying the mixing between the primary flow from the burner 46 and the secondary combustion air. This reduced air availability at the high temperature flame zone, and the resultant delayed air/flame mixing, serve to further reduce the $NO_x$ formation rate. A still further reduction in the $NO_x$ formation is achieved by the thermal "quenching" effect of the inserted metal reduction structure members 72 and 74 across which the flame 57 flows.

The unique $NO_x$ reduction apparatus 10 of the present invention retains the advantages of in-shot type fuel burners and conventional flame inserts, such as low cost and high turn-down ratio. It provides a stable and clean combustion over a wide burner operation range, is inexpensive to manufacture and easy to install, and lends itself quite well to retrofit applications. And, quite importantly, it provides a high degree of $NO_x$ emission reduction. For example, in its representative forced air heating furnace application illustrated and described herein, the $NO_x$ reduction apparatus 10 is operative to reduce $NO_x$ emissions to below 20 ng/j.

In developing the present invention it has been found that is important to properly size the tubular metal mesh member 74 in order to obtain desirable combustion characteristics relating to $NO_x$ and CO emission levels, combustion noise, ignition, etc. For example, as best shown in FIG. 7, it has been found to be preferable that the diameter $D_3$ of the metal mesh tube 74 be approximately equal to the diameter $D_1$ of the burner flame holder 68. Additionally, the preferred length $L_2$ of the mesh tube 74 is about half the length $L_1$ of the combustor tube 34. The preferred distance $X_1$ between the burner 46 and the metal mesh tube 74 is within the range of from about one to two times the tube diameter $D_3$.

The diameter of the metal wire used to form the mesh tube 74 and the mesh spacing of the tube have also been found to affect the $NO_x$ reduction capabilities of the structure 10. For example, the preferred wire diameter is about 0.014 inches, and the preferred mesh size, which provides a low $NO_x$ emission rate together with a clean combustion process, is approximately 30×32 (i.e., 30 openings per inch in one direction along the tube, and 32 openings per inch in the transverse direction).

Returning again to FIG. 5, it will be noted that the elongated support member 72 is anchored at only end portion 82 thereof to the combustor tube 34. Accordingly, the support member 72 is free to thermally contract and expand in a longitudinal direction, without transmitting an expansion or contraction force to the combustor tube, or receiving such thermal forces from the combustor tube. Additionally, as can also be seen in FIG. 5, the length of the metal mesh tube 74 is slightly shorter than the distance between the end portions 80,82 of the support member body 76, thereby permitting relative thermal contraction and expansion between the support member 72 and the metal mesh tube 74.

The foregoing detailed description is to be clearly understood as being given by way of illustration and example only, the spirit and scope of the present invention being limited solely by the appended claims.

What is claimed is:

1. A reduced $NO_x$ emission combustion system for a fuel-fired heating appliance, comprising:

a combustor tube having an open inlet end and an essentially straight combustion section longitudinally extending inwardly from said open inlet end and having an internal diameter;

a fuel burner operative to inject a flame and resulting hot combustion gases into said open inlet end for flow through said combustion section of said combustor tube in a manner drawing ambient combustion air into said combustion section around the flame, said fuel burner having a generally circular flame outlet section from which the flame is discharged, said flame outlet section being coaxial with said combustion section and having a diameter substantially smaller than said internal diameter of said combustion section;

a perforate tubular flame control member coaxially supported within said combustion section in the path of the fuel burner flame and having a diameter substantially less than said internal diameter of aid combustion section to thereby form between said perforate tubular flame control member and the interior side surface of said combustion section an annular combustion air flow space through which the ambient combustion air may flow in response to operation of said fuel burner, said perforate tubular flame control member having a diameter approximately equal to the diameter of aid flame outlet section of said fuel burner and being operative to cause an axial portion of the fuel burner flame to longitudinally pass therethrough in a manner reducing the lateral dimension of the axial flame portion, increasing its velocity, and substantially shielding it from intimate contact with the ambient combustion air entering said combustion section around the flame and flowing through said annular combustion air flow space, whereby said perforate tubular flame control member, during operation of said combustion system, functions to substantially reduce the $NO_x$ emission level of said combustion system.

2. The combustion system of claim 1 wherein:

said flame control member is formed from a metal mesh material.

3. The combustion system of claim 2 wherein:

said metal mesh material is formed from wire having a diameter of approximately 0.014 inches.

4. The combustion system of claim 2 wherein:

the mesh size of said flame control member is approximately 30×32.

5. The combustion system of claim 1 wherein:

said fuel burner is an in-shot type fuel burner.

6. The combustion system of claim 1 wherein:

the length of said flame control member is about one half the length of said combustion section of said combustor tube.

7. The combustion system of claim 1 wherein:

the axial distance between said fuel burner and said flame control member is within the range of from about one to about two times the diameter of said flame control member.

8. The combustion system of claim 1 wherein:

said flame control member is removably supported in said combustion section of said combustor tube.

9. A combustion system for a fuel-fired heating appliance, comprising:

a combustor tube having an open inlet end and an essentially straight combustion section horizontally extending inwardly from said open inlet end and having an internal diameter;

a fuel burner operative to inject a flame and resulting hot combustion gases into said open inlet end for flow through said combustion section of said combustor tube in a manner drawing ambient combustion air into said combustion section around the flame, said fuel burner having a generally circular flame outlet section from which the flame is discharged, said flame outlet section being coaxial with said combustion section and having a diameter substantially smaller than said internal diameter of said combustion section; and $NO_x$ reduction apparatus for substantially reducing the $NO_x$ emission rate of the heating appliance, said $NO_x$ reduction apparatus including:

a metal mesh tube having a diameter substantially smaller than the internal diameter of said combustion section and approximately equal to the diameter of said fuel burner flame outlet section, and a length substantially less than the length of said combustion section, and support means for removably supporting said metal mesh tube coaxially within said combustion section, adjacent said open inlet end, in a manner (1) causing the fuel burner flame to pass through and be laterally constricted and bounded along its periphery by said metal mesh tube during operation of said fuel burner, and (2) forming between said metal mesh tube and the interior surface of said combustion section an annular combustion air flow space through which the ambient combustion air may flow in response to operation of said fuel burner, whereby said metal mesh tube is operative to substantially shield the laterally constricted fuel burner flame within said metal mesh tube from combustion air traversing said annular combustion air flow space;

10. The combustion system of claim 9 wherein:
said metal mesh tube is formed from metal wire having a diameter of approximately 0.014 inches.

11. The combustion system of claim 9 wherein:
the mesh size of said metal mesh tube is approximately 30×32.

12. The combustion system of claim 9 wherein:
said fuel burner is an in-shot type fuel burner.

13. The combustion system of claim 9 wherein:
the length of said metal mesh tube is about one half the length of said combustion section of said combustor tube.

14. The combustion system of claim 9 wherein:
the axial distance between said fuel burner and said flame control member is within the range of from about one to about two times the diameter of said metal mesh tube.

15. A combustion system for a fuel-fired heating appliance, comprising:
a combustor tube having an open inlet end and an essentially straight combustion section horizontally extending inwardly from said open inlet end and having an internal diameter;
a fuel burner operative to inject a flame and resulting hot combustion gases into said open inlet end for flow through said combustion section of said combustor tube in a manner drawing ambient combustion air into said combustion section around the flame,
said fuel burner having a generally circular flame outlet section from which the flame is discharged, said flame outlet section being coaxial with said combustion section and having a diameter substantially smaller than said internal diameter of said combustion section; and
$NO_x$ reduction apparatus for reducing the $NO_x$ emission rate of the heating appliance, said $NO_x$ reduction apparatus including:
a metal mesh tube having a diameter substantially smaller than the internal diameter of said combustion section, and a length substantially less than the length of said combustion section, and
support means for removably supporting said metal mesh tube coaxially within said combustion section, adjacent said open inlet end, in a manner causing the fuel burner flame to pass through and be laterally constricted and bounded along its periphery by said metal mesh tube during operation of said fuel burner, said support means including an elongated support member longitudinally extendable through the interior of aid metal mesh tube and having a first end portion positionable outwardly beyond one end of said metal mesh tube and removably anchorable to said open inlet end of said combustor tube, and a second end portion positionable outwardly beyond the other end of said metal mesh tube and slidably restable on a bottom side surface of said combustor tube spaced inwardly apart from said open inlet end thereof, and means for removably anchoring said first end portion of said support member to said open inlet end of said combustor tube.

16. The combustion system of claim 15 wherein said means for removably anchoring include:
a notch formed in said first end portion of said support member, and
a rod member secured across said open inlet end of said combustor tube and receivable in a removably snap-fitted orientation within said notch.

17. A fuel-fired forced air heating furnace comprising:
a housing;
a supply air blower operative to flow air to be heated through said housing;
a heat exchanger interposed in the supply air blower air flow path, for transferring combustion heat to the air being flowed through said housing, said heat exchanger including a plurality of combustor tubes each having an open inlet end, an internal diameter, an outlet end, and an essentially straight combustion section longitudinally extending inwardly from said open inlet end and having a length;
a plurality of in-shot type fuel burners disposed in a facing orientation with said open inlet ends of said combustor tubes and operative to inject flames and resulting hot combustion gases thereinto, said fuel burners having generally circular flame holder sections coaxial with said open inlet ends of said combustor tubes and having diameters substantially less than the internal diameters of said combustor tubes, said fuel burners, during operation thereof, functioning to draw ambient air into said open inlet ends of said combustor tubes around the burner flames received therein;
a draft inducer fan having an outlet communicated with said outlet ends of said combustor tubes, said draft inducer fan being operative to draw hot combustion gases through said combustor tubes; and
$NO_x$ reduction apparatus for substantially reducing the $NO_x$ emission rate of said furnace, said $NO_x$ reduction apparatus including:
a plurality of metal wire mesh tubes having:
diameters substantially smaller than the internal diameters of said combustor tubes and approximately equal to the diameters of said flame holder sections of said fuel burners,
wire diameters of approximately 0.014 inches,
mesh sizes of approximately 30×32, and
lengths about one half the lengths of said combustion sections of said combustor tubes,
the axial distance between each fuel burner and its associated metal wire mesh tube being within the range of from about one to about two times the diameter of the metal wire mesh tube, and
support means for removably supporting said metal wire mesh tubes coaxially within said combustion sections of said combustor tubes, adjacent said open inlet ends thereof, in a manner (1) causing the fuel burner flames to pass through and be laterally constricted and bounded along their peripheries by said metal wire mesh tubes during operation of said fuel burners, and (2) forming between said metal wire mesh tubes an the interior surfaces of their associated combustor tube combustion section annular combustion air flow spaces thorough which the ambient combustion air may flow during operation of said fuel burners, whereby said metal wire mesh tubes are operative to substantially shield the laterally constricted fuel burner flames within said metal wire mesh tubes from combustion air traversing said annular combustion air flow spaces.

18. A fuel-fired forced air heating furnace comprising:

a housing;

a supply air blower operative to flow air to be heated through said housing;

a heat exchanger interposed in the supply air blower air flow path, for transferring combustion heat to the air being flowed through said housing, said heat exchanger including a plurality of combustor tubes each having an open inlet end, an internal diameter, and an outlet end;

a plurality of in-sot type fuel burners disposed in a facing orientation with said open inlet ends of said combustor tubes and operative to inject flames and resulting hot combustion gases thereinto, said fuel burners having generally circular flame holder sections coaxial with said open inlet ends of said combustor tubes and having diameters substantially less than the internal diameters of said combustor tubes;

a draft inducer fan having an outlet communicated with said outlet ends of said combustor tubes, said draft inducer fan being operative to draw hot combustion gases through said combustor tubes; and $NO_x$ reduction apparatus for reducing the $NO_x$ emission rate of said furnace, said $NO_x$ reduction apparatus including:

a plurality of metal mesh tubes having diameters substantially smaller than the internal diameters of said combustor tubes, and support means for removably supporting said metal mesh tubes coaxially within said combustor tubes, adjacent said open inlet ends thereof, in a manner causing the fuel burner flames to pass through and be laterally constricted and bounded along their peripheries by said metal mesh tubes during operation of aid fuel burners, said support means including a plurality of elongated support members longitudinally extending through said metal mesh tubes and having first ends anchored to said open inlet ends of said combustor tubes, and second ends slidably resting on interior side portion of said combustor tubes.

19. A reduced $NO_x$ emission combustion system for a fuel-fired heating appliance, comprising:

a combustor tube having an open inlet end and an essentially straight combustion section longitudinally extending inwardly from said open inlet end and having an internal diameter;

a fuel burner operative to inject a flame and resulting hot combustion gases into said open inlet end for flow through said combustion section of said combustor tube in a manner drawing ambient combustion air into said combustion section around the flame, said fuel burner having a generally circular flame outlet section from which the flame is discharged, said flame outlet section being coaxial with said combustion section and having a diameter substantially smaller than said internal diameter of said combustion section; and a perforate tubular flame control member coaxially supported within said combustion section in the path of the fuel burner flame and having a diameter substantially less than said internal diameter of aid combustion section to thereby form between said perforate tubular flame control member and the interior side surface of said combustion section an annular combustion air flow space through which the ambient combustion air may flow in response to operation of said fuel burner, said flame control member being operative to cause an axial portion of the fuel burner flame to longitudinally pass therethrough in a manner reducing the lateral dimension of the axial flame portion, increasing its velocity, and substantially shielding it from intimate contact with the ambient combustion air entering said combustion section around the flame and flowing through said annular combustion air flow space, said perforate tubular flame control member being coaxially supported within said combustion section by means of an elongated support member longitudinally extending through the interior of said flame control member and having a first end portion positioned outwardly beyond one end of said flame control member and removably anchored to said open inlet end of said combustor tube, and a second end portion positioned outwardly beyond the other end of said flame control member and slidably engaging a side surface of said combustor tube spaced inwardly apart from said open inlet end thereof.

* * * * *